United States Patent [19]

Tsuchiyama et al.

[11] Patent Number: 4,742,210

[45] Date of Patent: May 3, 1988

[54] ELECTRIC HEATING APPARATUS HAVING A UNIVERSAL ELECTRICAL CONNECTOR

[75] Inventors: Yuji Tsuchiyama, Nitta; Yoshiki Ikari, Ashikaga; Yamada Wazou, Ohizumi, all of Japan

[73] Assignee: Sanyo Electric Co., Ltd., Japan

[21] Appl. No.: 921,955

[22] Filed: Oct. 21, 1986

[30] Foreign Application Priority Data

| | | | |
|---|---|---|---|
| Oct. 23, 1985 | [JP] | Japan | 60-162269[U] |
| Apr. 30, 1986 | [JP] | Japan | 61-65585[U] |
| Apr. 30, 1986 | [JP] | Japan | 61-65586[U] |
| May 6, 1986 | [JP] | Japan | 61-67806[U] |

[51] Int. Cl.[4] ..... H05B 3/62

[52] U.S. Cl. ..... 219/541; 219/256; 219/488

[58] Field of Search ..... 219/483, 486, 541, 484, 219/485, 487, 488, 240, 249, 250, 256; 339/18 R, 18 P, 32 R, 32 M, 33, 31 M, 19, 222; 307/42

[56] References Cited

U.S. PATENT DOCUMENTS

| | | | |
|---|---|---|---|
| 2,259,258 | 10/1941 | McCormick | 219/488 |
| 4,386,333 | 5/1983 | Dillan | 339/31 M X |

FOREIGN PATENT DOCUMENTS

| | | | |
|---|---|---|---|
| 538291 | 10/1955 | Belgium | 339/31 M |
| 641915 | 12/1963 | Belgium | 219/488 |
| 1112368 | 3/1956 | France | 219/26 X |
| 1289545 | 2/1962 | France | 219/240 X |
| 1392264 | 2/1965 | France | 339/31 M |

*Primary Examiner*—Patrick R. Salce
*Assistant Examiner*—Emanuel T. Voeltz
*Attorney, Agent, or Firm*—Darby & Darby

[57] ABSTRACT

The present invention provides an electric heating apparatus comprising a plurality of electric heaters and cords for supplying electric power to the heaters through a connector, wherein the connector consists of two separable members, the one member (the primary connector) of the connector has a plurality of contacts and at least one conductor, the cords being separately connected to the contacts, the conductor electrically short-circuiting two contacts of the primary connector which are so selected that the conductor can form a part of a circuit for supplying electric power to a desired heater, the another member (the secondary connector) of said connector has a plurality of contacts being connected only with predetermined contacts of the primary connector, and the contacts of the secondary connector form a part of the circuit for supplying electric power to the desired heater with the contacts and the conductor of the primary connector, wherby heaters to be supplied with electric power can be determined by selecting the two contacts short-circuited by the conductor. Accordingly, the electric heater capacity of the present heating apparatus is readily changeable merely by changing the connection of the conductor for use with another power supply with different maximum currents capable of flowing safety through a branch circuit.

4 Claims, 9 Drawing Sheets

ELECTRIC HEATING APPARATUS HAVING A UNIVERSAL ELECTRICAL CONNECTOR

BACKGROUND OF THE INVENTION

1. Field of the Invention

The present invention relates to a heating apparatus having a plurality of electric heaters, such as an air conditioner having electric heaters, electric fan heater system or other electric heater, and more particularly to a heating apparatus which is so adapted that current can be selectively passed through at least one of the electric heaters incorporated therein in accordance with the maximum current capable of flowing safely through a branch circuit.

2. Description of the Prior Art

Heating apparatus incorporating an electric heater and heretofore used generally include the one disclosed in Unexamined Japanese Patent Publication No. SHO 48-2943.

With the disclosed apparatus, the current to be passed through the electric heater is controlled according to the operating condition of the apparatus, and the capacity of the electric heater is so determined as to give a maximum amount of heat generation in accordance with the capacity of the circuit breaker or with the voltage value of the power supply to which the heating apparatus is connected.

In the United States, however, current of different values, e.g. 15A, 20A and 30A, are supplied from wall receptacles of specific configurations corresponding to the maximum current capable of flowing safely through a branch circuit. Therefore, when the heating apparatus is to be connected to a receptacle different from the specified one in the volume of current capable flowing safely through a branch circuit, there arises a need to use an electric heater of a capacity in conformity with the receptacle. Thus, the heating apparatus is not usable universally.

Accordingly, with attention directed to the fact that the configuration of wall receptacles differ with the maximum current capable of flowing safely through a branch circuit, the present invention provides a heating apparatus which is readily usable at the different maximum current capable of flowing safely through a branch circuit.

SUMMARY OF THE INVENTION

It is a general object of the present invention to provide an electric heating apparatus which is usable universally at any maximum current capable of flowing safely through a branch circuit of the power supply without using different types of the apparatus.

The present invention provides an electric heating apparatus comprising a plurality of electric heaters and cords for supplying electric power to the heaters through a connector, wherein the connector consists of two separable members, the one member (the primary connector) of the connector has a plurality of contacts and at least one conductor, the cords being separately connected to the contacts, the conductor electircally short-circuiting two contacts of the primary connector which are so selected that the conductor can form a part of a circuit for supplying electric power to a desired heater, the other member (the secondary connector) of the connector has a plurality of contacts being connected only with predetermined contacts of the primary connector, and the contacts of the secondary connector form a part of the circuit for supplying electric power to the desired heater with the contacts and the conductor of the primary connector, whereby heaters to be supplied with electric power can be determined by selecting the two contacts short-circuited by the conductor.

Accordingly, the electric heater capacity of the present heating apparatus is readily changeable merely by changing the connection of the conductor for use with another power supply of the different maximum current capable of flowing safely through a branch circuit. Consequently, the manufacturer or dealers of the electric heating apparatus need not prepare stocks of different types for use at the different maximum current capable of flowing safely through a branch circuit.

According to a preferred embodiment of the invention, the apparatus has a plug connected with the cords, the plug being formed to fit in a wall receptacle in accordance with the volume of current capable flowing safely through a branch circuit, the two contacts being selected in corresponding relation to the plug, whereby the heaters to be supplied with electric power are selected.

The apparatus is an air conditioner having a path of air flow induced by a fan and has the heaters in the path.

The apparatus may further comprise a relay with normally open contacts, the contacts of the relay being so connected with the contacts of the secondary connector that the relay can control supplying electric power to the heater selected by the conductor.

The apparatus may have a control circuit for controlling the relay.

DESCRIPTION OF THE PREFERRED EMBODIMENTS

Figure 1:
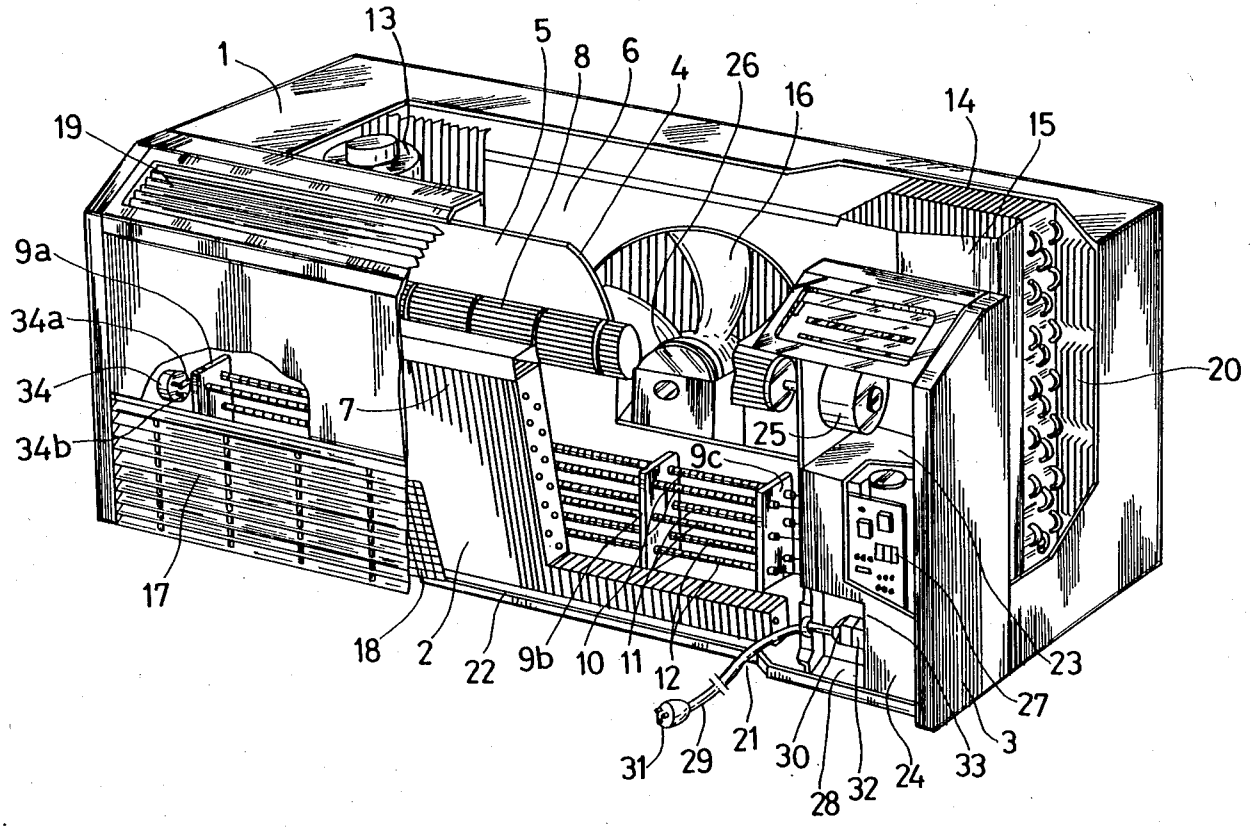
FIG. 1 is a perspective view partly broken away and showing an air conditioner embodying the present invention.

FIG. 1 is a perspective view showing an air conditioner and partly broken away to show the interior thereof. The air conditioner comprises a main body 1 the rear half of which is to be placed in a building wall, and a cover panel 3 closing a front opening 2 of the main body 1.

The interior of the main body 1 is divided into an inside chamber 5 at the front side and an outside chamber 6 at the rear side by a partition 4. Accommodated in the inside chamber 5 is a plate fin evaporator 7, a cross-flow fan 8, and a first 2-kW electric heater 10, a second 1.5-kW electric heater 11 and a third 1.5-kW electric heater 12 which are held by support plates 9a, 9b and 9c. The outside chamber 6 has accommodated therein a compressor 13, a plate fin condenser 14, a fan casing 15 and a propeller fan 16. Air in a room is drawn in through an air intake grille 17 of the panel 3, passed through an air filter 18, the evaporator 7 and the electric heaters 12, 10, 11 one after another, and sent out into the room through a discharge grille 19 of the panel 3 by the crossflow fan 8. On the other hand, outside air is drawn in through opposite side grilles 20 in the rear side of the main body , forced against the condenser 14 by the propeller fan 16 and discharged to the outside through a central grille (not shown) in the rear side. The air in the room is cooled by the evaporator 7 during cooling operation or is heated by the electric heaters 10, 11, 12 during heating operation.

The main body 1 has a lower edge 22 which is recessed at its middle portion to provide an opening 21 between the edge and the cover panel 3. The interior air is partly drawn in through the opening 21 and joins the flow of air drawn in through the intake grille 17.

A control box 23 is housed in the main body 1 at the right side of the inside chamber 5 and has a front panel 24 positioned at the front opening 2. The control box 23 has accommmodated therein electric parts 27 for controlling the operation of, and supply of current to, the compressor 13, a motor 25 for the cross-flow fan 8, a motor 26 for the propeller fan 16 and the electric heaters 10, 11, 12.

A power supply connection chamber 28 is formed by recessing the control box 23 at the portion thereof opposed to the opening 21. A power cord 29 has a primary connector 30 at its one end and a plug 31 at the other end thereof and extends outward from the main body 1 through the opening 21. A secondary connector 32, which is connectable to the primary connector 30 within the connection chamber 28, is disposed in the chamber 28 and fixed to a side wall 33 thereof opposed to the opening 21.

A protector 34 comprises a temperature fuse 34a and a bimetallic thermostat 34b for preventing the heaters 10, 11, 12 from overheating.

Figure 2:
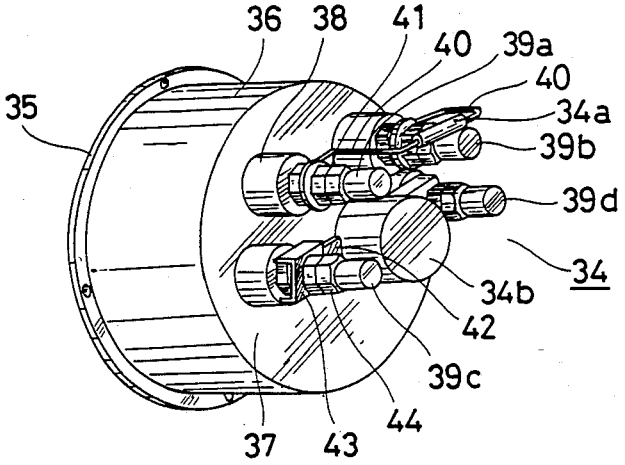
FIG. 2 is a perspective view showing an overheating preventing protector.
Figure 3:
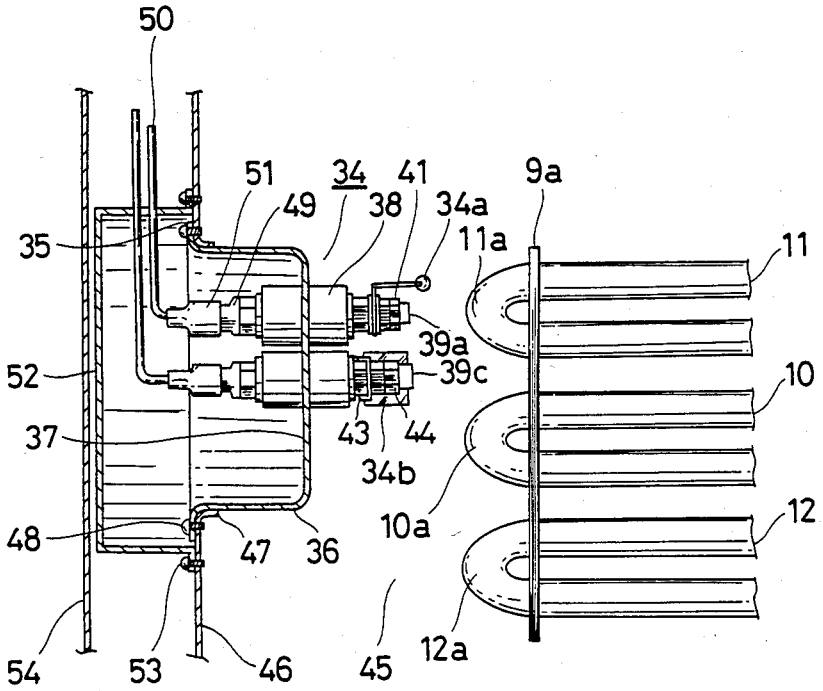
FIG. 3 is a view partly in vertical section showing the arrangement of the heaters of the air conditioner and the protector as attached to the air conditioner.

FIG. 2 is a perspective view showing the overheating preventing protector 34, and FIG. 3 is a view in vertical section showing the protector 34. The protector 34 has a hollow cylindrical mount 36 having a bottom portion 37 and a peripheral flange 35, and four support members 39a, 39b, 39c, 39d each having an insulator 38 extending through the bottom portion 37 of the mount 36. The temperature fuse 34a is attached to the mount 36 by a pair of lead wires 40 fastened to the two support members 39a, 39b with nuts 41. The thermostat 34b is attached to the mount 36 by inserting a pair of male terminals 42 into female terminals 43 and fastening the female terminals 43 to the support members 39c, 39d with nuts 44. The protector 34 can be completely installed in place by inserting the mount 36 thus having the fuse 34a and the thermostat 34b attached thereto through a hole 47 in a side plate 46 defining the path 45 of flow of the interior air from the left side in FIG. 3, fastening the mount 36 to the plate 46 with screws 48, inserting female terminals 51 each having a lead wire 50 into male terminals 49 inside the mount 36 and fastening a closure 52 to the side plate 46 with screws 53. Indicated at 54 is a side portion of the cover panel 3 attached to the main body 1 after the completion of installation.

FIG. 3 shows the arrangement of the protector 34 and the heaters 10, 11, 12 thus provided side by side within the path 45 through which the interior air flows from below upward. The heaters 10, 11, 12, each comprising a U-shaped heat generating wire, are supported by the support plates 9a, 9b, 9c with the front portion of the wire at a slightly lower level than the rear portion thereof. Current is passed through the first heater 10 in the middle stage independently, while the second heater 11 in the upper stage is energized simultaneously with the first heater. Current is passed through the third heater 12 in the lower stage simultaneously with the first and second heaters 10, 11. The protector 34 is opposed to the U-shaped portions 10a, 11a, 12a of the heaters and positioned at a level higher than the first heater 10 but not higher than the second heater 11. Stated more specifically, the thermostat 34b is at a level between the first and second heaters 10, 11, while the temperature fuse 34a is at the same level as the upper half of the second heater 11 and is positioned slightly closer to the heaters 10 to 12 than the thermostat 34b.

Figure 4:
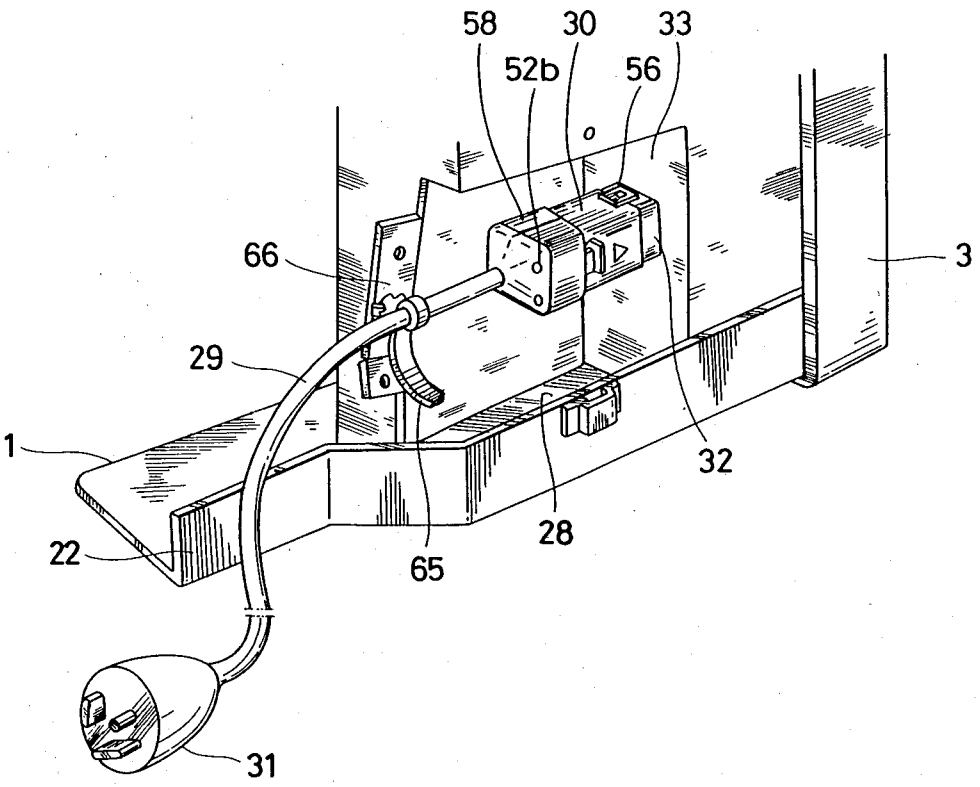
FIG. 4 is an enlarged perspective view showing a power supply connection chamber of the air conditioner.
Figure 5:
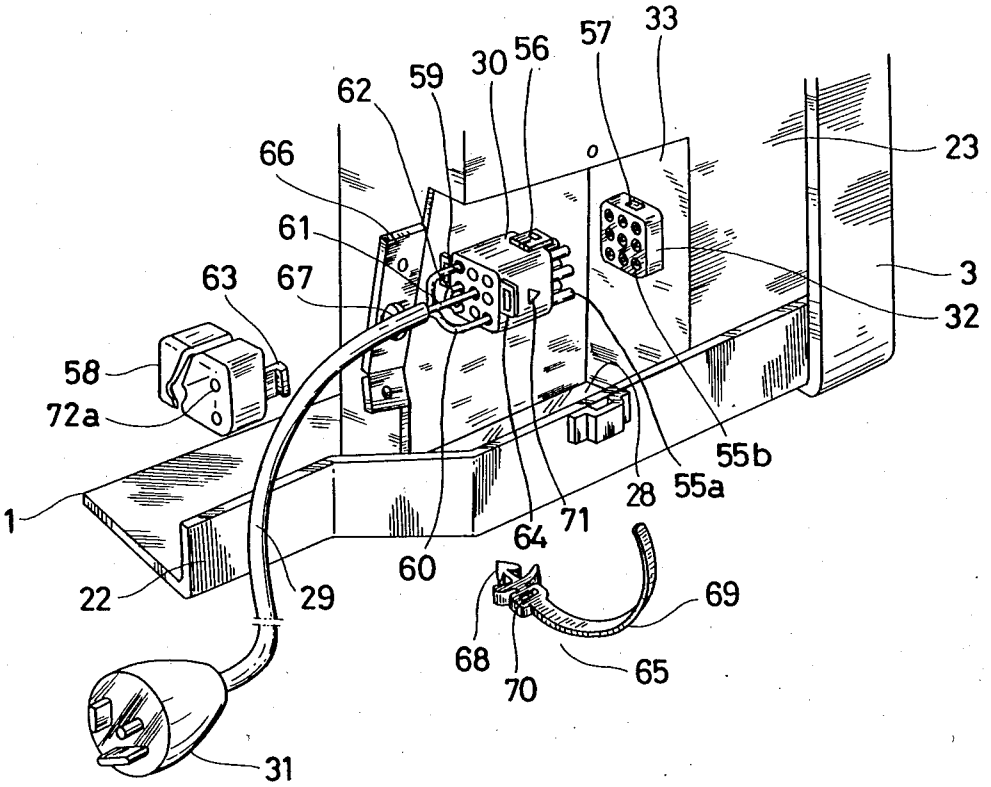
FIG. 5 is an exploded perspective view showing a primary connector and a secondary connector in the power supply connection chamber.

FIG. 4 is an enlarged perspective view showing the power supply connection chamber 28, and FIG. 5 is an exploded perspective view showing the primary and secondary connectors 30 and 32. The secondary connector 32, which is fixedly fitted in the side wall 33, is connected to the electric parts 27 within the control box 23 and to the electric heaters 10, 11, 12 and is formed with nine socket bores 55b into which nine projections 55a on the primary connector 30 are fittable respectively. Each of the projections 55a has a contact therein, while each of the socket bore 55b also has a contact therein. When the primary connector 30 and the secondary connector 32 are fitted together, each contact of the primary connector 30 is connected only to the specified one of the contact of the secondary connector 32. Thus, the primary connector is fittable to the secondary connector only at a specified angle of rotation therewith.

First engaging pieces 56 provided on the upper and lower surfaces of the primary connector 30 are engageable with first lugs 57 on the secondary connector 32. A connector cover 58 covers lead wires 59, 60, 61 and a short-circuiting wire 62 which are connected to the primary connector 30. Second engaging pieces 63 provided on opposite sides of the connector cover 58 are engageable with second engaging pieces 64 on the primary connector 30. A cord clip 65 comprises a belt 69 having an arrowhead 68 and a rectangular hole 70 at its one end for fastening the power cord 29 to a retaining piece 66 of the connection chamber 28 by fitting the arrowhead 68 into a hole 67 in the retaining piece 66 and forcing the other end of the belt 69 into the hole 70. A mark 71 indicates the direction of insertion of the primary connector 30.

The connector cover 58 is divided into two opposed symmetric portions which, when fastened together with screws (not shown) inserted into screw holes 72a, clamp the power cord 29 therebetween to prevent removal of the lead wires 59, 60, 61 from the primary connector 30 even if the power cord 29 is forcibly pulled.

Figure 6:
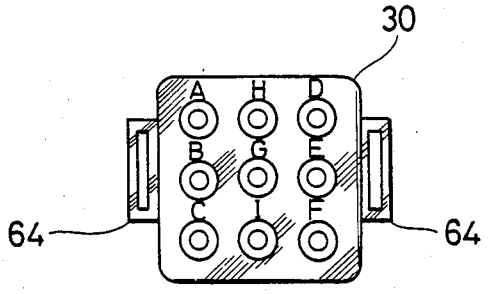
FIG. 6 is a front view showing the primary connector.

FIG. 6 is a front view showing the primary connector 30 having terminals (connecting elements) A to I arranged as illustrated. According to the embodiment shown in FIG. 5, the lead wire 59 is inserted in a bore for the terminal A, the lead wire 60 in a bore for the terminal F and the lead wire 61 in a bore for the terminal G. The short-circuiting wire 62 is inserted in bores for the terminals B and C to interconnect these terminals.

Figure 7:
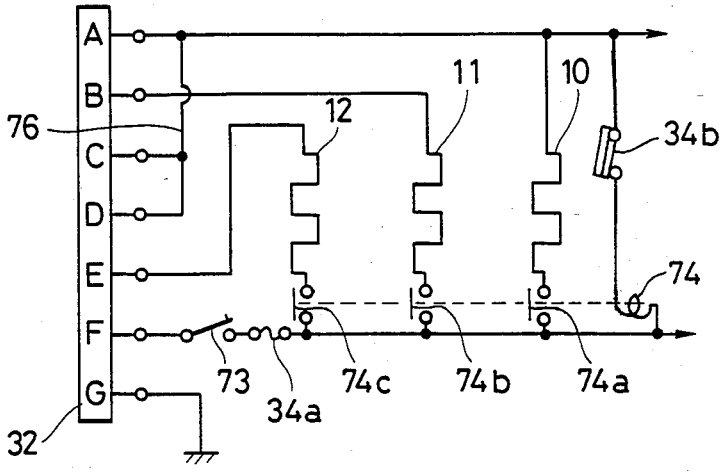
FIG. 7 is a diagram showing a wiring for the connecting elements of the secondary connector and electric heaters.

FIG. 7 is a wiring diagram for the secondary connector 32. A series circuit of the bimetallic thermostat 34*b* and a relay 74 and a series circuit of the electric heater 10 and a relay contact 74*a* in parallel with the circuit are connected between terminals (contacts)A and F of the secondary connector 32 via the temperature fuse 34*a* and an operation switch 73. A series circuit including the electric heater 11 and a relay contact 74*b* are connected to a terminal B, and a series circuit including the electric heater 12 and a relay contact 74*c* are connected to a terminal E and also connected to the terminal F via the temperature fuse 34*a* and the operation switch 73. Further the terminal A and terminals C and D are interconnected by a wire 76. A terminal G for grounding is connected to a metal portion of the main body 1.

Figure 8:
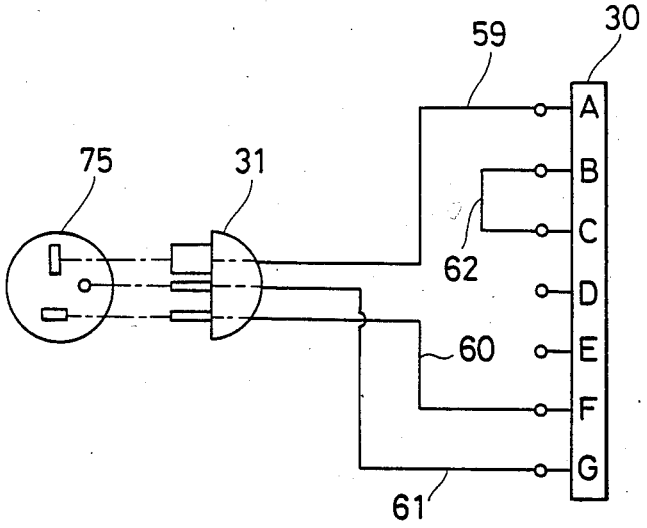
FIG. 8 is a diagram showing an example of wiring for the primary connector and the plug respectively illustrated with its symbol.

FIG. 8 shows the wiring of the primary connector 30 when the apparatus is used for a receptacle 75 with the maximum current capable of flowing safely through a branch circuit of 20 A. The lead wires 59, 60, 61 and the short-circuiting wire 62 are connected to the terminals (contacts A, F, G and B, C, respectively, as illustrated and already stated above. The plug 31 is so shaped as to fit in the 20-A receptacle 75.

When the operation switch 73 of FIG. 7 is turned on with the primary connector 30 connected to the secondary connector 32, the relay 74 is energized to close the contacts 74*a*, 74*b* and 74*c* which are usually open, provided that the temperature fuse 34*a* of the protector 34 is not broken, with the contact of the bimetallic thermostat 34*b* closed. Consequently, electric power is supplied to the 2-KW middle heater 10 connected between the terminals A and F. At the same time, the power supplied to the terminal A is fed to the terminal B of the secondary connector 32 via the wire 76, terminal C, and wire 62 on the primary connector 30 and then to the 1.5-kW upper heater 11 connected to the terminal B.

Figure 9:
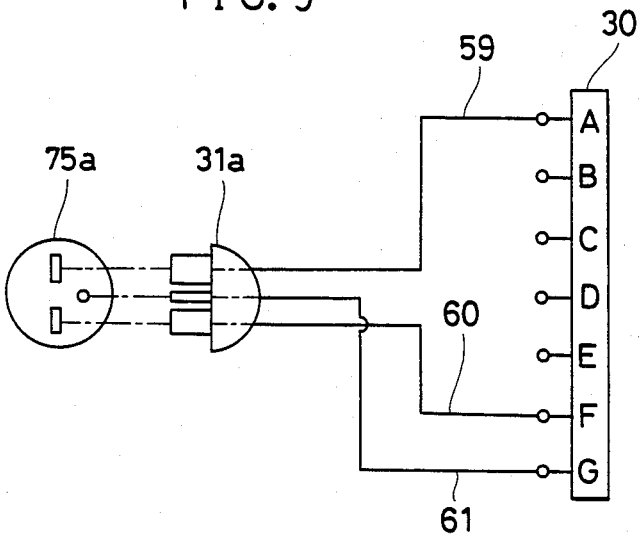
FIG. 9 is a diagram showing another example of wiring for the primary connector and the plug respectively illustrated with its symbol.

FIG. 9 shows the wiring of the primary connector 30 for use at the maximum current capable of flowing safely through a branch circuit of 15 A. This wiring differs from that of FIG. 8 in that the short-circuiting wire 62 is absent and that a plug 31*a* is shaped in conformity with the configuration of a 15-A receptacle 75*a*. When the operation switch 73 is turned on with the primary and secondary connectors 30 and 32 connected together, the 2-kW middle heater 10 only is energized.

Figure 10:
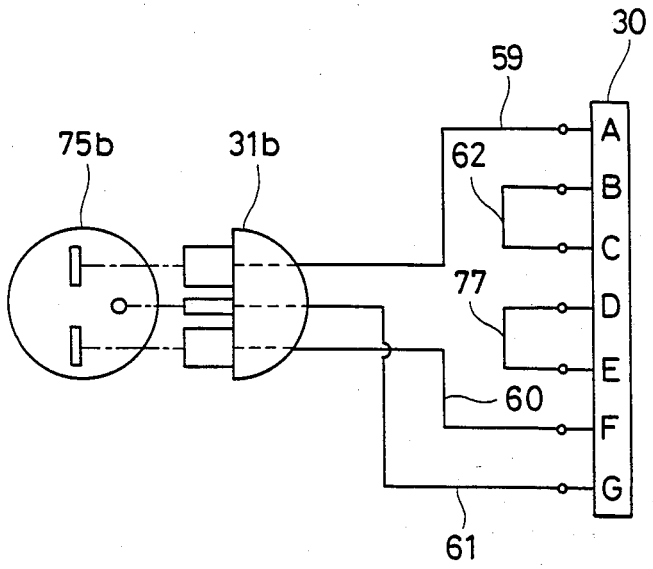
FIG. 10 is a diagram showing another example of wiring for the primary connector and the plug respectively illustrated with its symbol.

FIG. 10 shows the wiring of the primary connector 30 for use at the maximum current capable of flowing safely through a branch circuit of 30 A. This wiring differs from that of FIG. 8 in that the terminals D and E are interconnected by a short-circuiting wire 77 and that a plug 31*b* is shaped in conformity with the configuration of a 30-A receptacle 75*b*. When the operation switch 73 is turned on with the connectors 30 and 32 connected together, electric power is supplied to the 2-KW middle heater 10 and also through the upper and lower 1.5-kW heaters 11, 12 via the wire 76 and short-circuiting wires 62, 77.

The temperature fuse 34*a* breaks when the heat generating temperature of the heaters 10, 11 and 12 rises to 120° C., while the contact of the thermostat 34*b* opens at 65° C. When the thermostat 34*b*; opens, the relay 74 is deenergized to open the contacts 74*a* to 74*c* and discontinue the supply of current to the heaters 10, 11 and 12.

The wirings of the primary connector 30 described above are all for use as the same rated power supply voltage. When a different rated power supply voltage is used, the terminals H and I shown in FIG. 6 are employed.

Thus, the electric heater or heaters to be energized are selected in accordance with the maximum current capable of flowing safely through a branch circuit by interconnecting the terminals B and C, D and E of the primary connector 30 by the short-circuiting wire 62 or 77 and selectively using one of the plugs 31, 31*a* and 31*b*.

Figure 11:
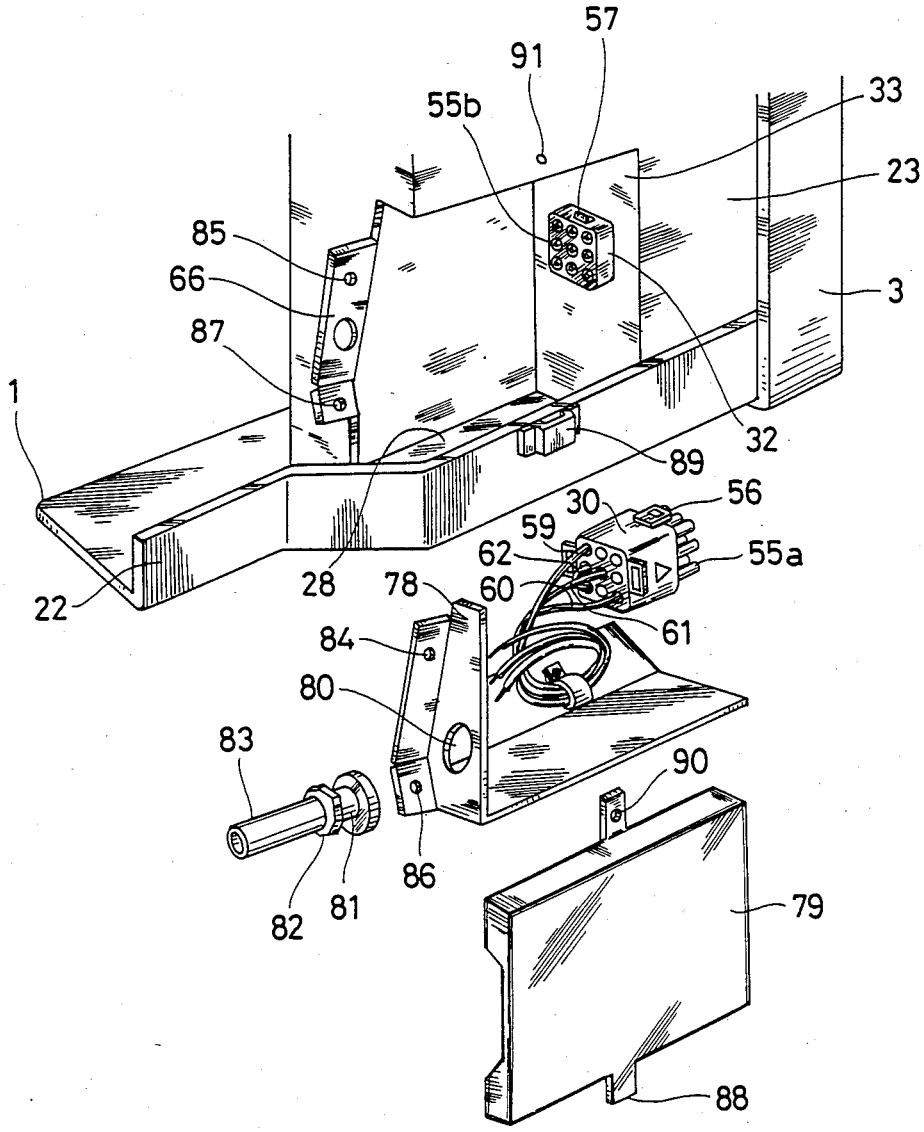
FIG. 11 is an exploded perspective view corresponding to FIG. 5 and showing another set of primary and secondary connectors embodying the invention.

FIG. 11 shows another embodiment as a substitute for the embodiment shown in FIG. 5. In place of the plugs 31, 31*a* and 31*b* and the connector cover 58, this embodiment includes a side cover 78 for closing one side and the bottom of the power supply connection chamber 28, a front cover for closing the front side of the chamber 28 and a metal pipe 83 having one end 81 inserted through a hole 80 in the side cover 78 and fixed to the cover 78 with a nut 82 for passing therethrough a cord (not shown) directly connectable to a power supply.

These members can be installed in place by fastening the side cover 78 to the retaining piece 66 with screws inserted through a hole 84 in the cover 78 and a hole 85 in the piece 66 and through like holes 86 and 87, fixing the metal pipe 83 to the side cover 78, connecting the power cord extending through the pipe 83 to the lead wires 59, 60 and 61 inside the side cover 78, connecting the primary connector 30 to the secondary connector 32, then inserting a lug 88 on the front cover 79 into an engaging piece 89 on the main body 1 from above, and fastening the front cover 79 to the control box 23 with a screw inserted through a hole 90 and a screw hole 91, as illustrated. Since the power supply connection chamber 28 can then be completely separated off from the outside, the above arrangement eliminates the likelihood that the hand will receive an electric shock by contact with the connection of the lead wire 59, 60 or 61 when the air filter 18 is cleaned or the evaporator 7, heaters 10, 11, 12, cross-flow fan 8, etc. are inspected after removing the cover panel 3.

With the present embodiment, the heater or heaters 10, 11, 12 to be energized are selectable in accordance with the maximum current capable of flowing safely through a branch circuit available, merely by connecting the short-circuiting wire 62 or wires 62 and 77 to the primary connector 30. Accordingly, for use with wall receptacles of the different maximum current capable of flowing safely through a branch circuit, the different cords shown in FIGS. 8 to 10 are prepared. The heater or heaters are then automatically selectable by using the power supply cord with the plug conforming to the configuration of the receptacle to be used. This renders the air conditioner usable universally.

While the heater or heaters to be used are thus selected according to the maximum current capable of flowing safely through a branch circuit, it is likely that the motor 25 for the cross-flow fan 8 will malfunction to stop the flow of air or the air filter 18 will be clogged up to result in a reduced air flow rate while the first to third heaters 10 to 12 or the first and second heaters 10, 11 are simultaneously operating for heating. The heat generating temperature of the heaters 10 to 12, or 10 and 11 will then rise abnormally. The overheating preventing protector 34 is exposed to the heat released from the U-shaped portions 10*a* and 12*a* of the first and third heaters 10 and 12 while the heat is being transferred upward and diffused by spontaneous convection and the air flow. At the same time, the heat released from the U-shaped portion 11*a* of the second heater 11 is delivered to the protector 34 by radiation. Thus, the protector 34 is sensitive to the heat from all the heaters 10 to 12 at all times when they are energized. Upon the heat generating temperature reaching 65° C. to which the thermostat 34*b* is set, the contact of the thermostat 34*b* opens to deenergize the relay 74, opening the contacts 74*a*, 74*b* and 74*c* to discontinue the supply of current to the heaters 10 to 12.

If the heat generating temperature of the heaters 10 to 12 reaches 120° C. to which the temperature fuse 34*a* is set, the fuse 34*a* breaks to deenergize the heaters 10 to 12. In this case, the temperature fuse 34*a*, which is positioned as deviated from the thermostat 34*b*, is rapidly heated with the heat released from the first and third heaters 10 and 12 and transferred upward by spontaneous convection and air flow while being heated with the radiant heat from the second heater 11.

Further if the heat generating temperature of the first heater 10 rises abnormally while this heater alone is operating for heating, the protector 34 is exposed to the heat which is diffused and transferred upward by spontaneous convection and air flow, so that the thermostat 34*b* opens at 65° C. or the temperature fuse 34*a* breaks at 120° C. quickly.

Although three electric heaters 10 to 12 are usef for the foregoing embodiments, at least two heaters, i.e. the first and second heaters 10 and 11 may be used. Further only one of the temperature fuse 34*a* and the thermostat 34*b* may be used for the protector 34.

Figure 12:
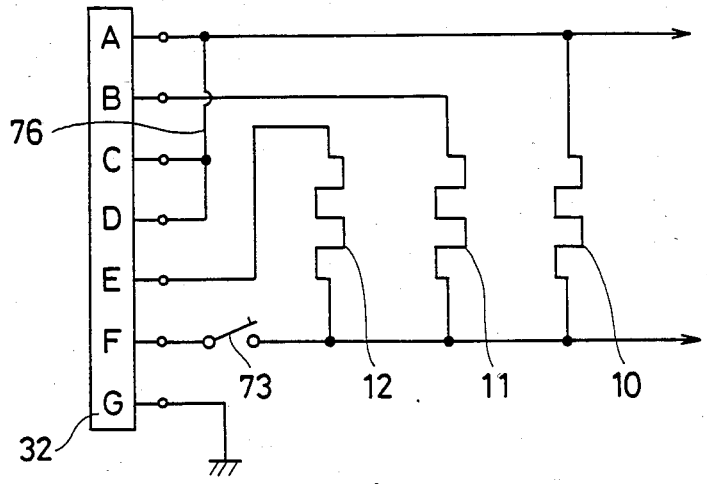
FIG. 12 is a diagram corresponding to FIG. 7 and showing another example of wiring for the contacts of the secondary connector and the electric heaters.

FIG. 12 is a fragmentary diagram showing the electric circuit of another embodiment of the present invention, as a substitute for the wiring of FIG. 7. The electric heaters 10, 11 and 12 are connected, each at its one end, to the terminal F of the secondary connector 32 via the operation switch 73 and are connected at the other ends thereof to the terminals A, B and E, respectively, of the secondary connector 32. The terminal A of the connector 32 is also connected to the terminals C and D by a wire 76.

The terminal G is grounded. The terminals A and F also serve to supply power to the fan motor and control unit.

Briefly, FIG. 12 shows a basic electric circuit corresponding to the circuit of FIG. 7 from which the temperature fuse 34*a*, bimetallic thermostat 34*b*, relay 74 and usually open contacts 74*a*, 74*b*, 74*c* are removed. When the primary connector 30 shown in one of FIGS. 8 to 10 is connected to the secondary connector 32 shown in FIG. 12, the heater or heaters are selected in accordance with the maximum current capable of flowing safely through a branch circuit available.

Figure 13:
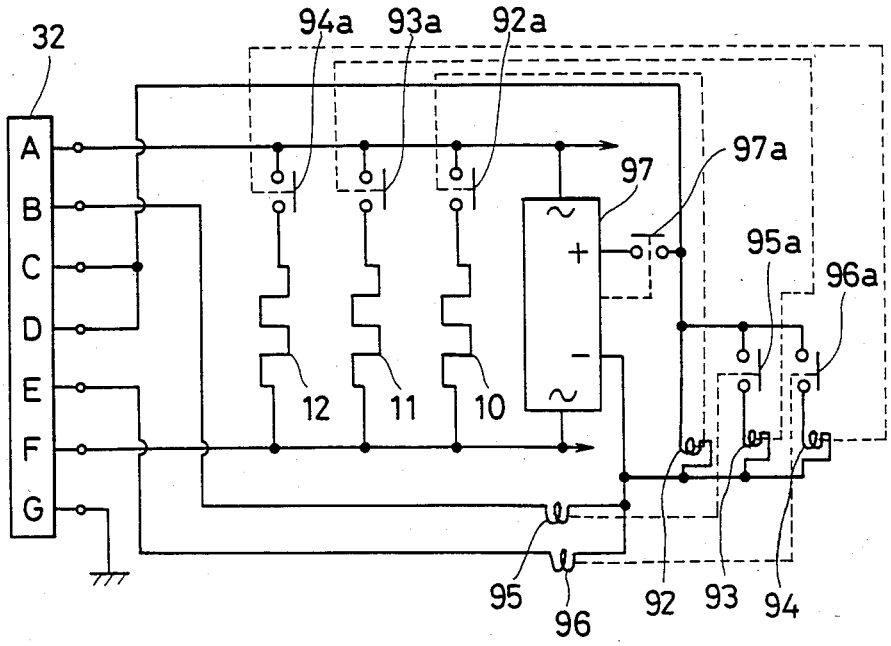
FIG. 13 is a diagram corresponding to FIG. 7 and showing another example of wiring for the same.

FIG. 13 shows another wiring embodying the present invention and substituting for the one shown in FIG. 7. The electric heaters 10, 11 and 12 are connected between the terminals A and F of the secondary connector 32 via usually open contacts 92*a*, 93*a*, 94*a* of relays 92, 93, 94. A control circuit 97 has a usually open contact 97*a* which is closed when the room temperature lowers below a specified level or when a set time is reached, i.e. when the electric heater needs to be operated. When the contact 97*a* is closed, the relay 92 is energized to close the contact 92*a* and pass current through the heater 10. The contact 97*a* is further connected to the terminals C and D of the secondary connector 32. The terminals B and E of the secondary connector 32 are connected to a minus terminal of the control circuit 97 via relays 95 and 96, respectively. These relays 95, 96 have usually open contacts 95*a*, 96*a* for controlling energization of the relays 93, 94.

When the primary connector 30 wired as shown in FIG. 9 is connected to the secondary connector 32, the heater 10 only can be energized. When the primary connector 30 wired as shown in FIG. 8 is connected to the connector 32, the heaters 10 and 11 only can be energized since the contact 95*a* is closed. Further when the primary connector 30 wired as shown in FIG. 10 is connected to the connector 32, the heaters 10, 11 and 12 can be energized since the contacts 95*a* and 96*a* are closed.

What we claimed is:

1. An electric heating apparatus having a universal electrical connector comprising a plurality of electric heaters, at least two supplying cords for supplying electric power to said heaters, a ground cord, a plug with blades;

said blades of the plug fitting a wall receptacle having a configuration corresponding to the maximum current capable of flowing safely through a branch circuit;

a first end of each of said supplying cords and ground cord are connected to each of said blades;

said connector consisting of separable first and second members;

said first member having a plurality of contacts and at least one conductor, a second end of each said supplying cords and ground cord and at least three said contacts being connected to said first member of said connector, said conductor electrically short-circuiting some of said contacts selected so as to correspond to a size and arrangement of said blades and forming a part of an electrical circuit for energizing the predetermined heater said second member having contacts connected only with predetermined contacts of said first member, said contacts of said second member forming a part of said circuit for energizing said predetermined heaters, and said predetermined heater can be energized through said connector.

2. An apparatus according to claim 1, wherein said apparatus is an air conditioner having a path of air flow induced by a fan and having said heaters within said path.

3. An apparatus according to claim 1, wherein said apparatus has a relay with normally open contacts, said normally open contacts of said relay connected to said contacts of said second member so that said relay may control supplying electric power to said predetermined heater.

4. An apparatus according to claim 3, wherein said apparatus has a control circuit for controlling said relay.

* * * * *